US005688178A

United States Patent [19]

Emrie

[11] Patent Number: 5,688,178

[45] Date of Patent: Nov. 18, 1997

[54] AMUSEMENT RIDE

[75] Inventor: Michael W. Emrie, Andover, Kans.

[73] Assignee: Chance Industries, Inc., Wichita, Kans.

[21] Appl. No.: 597,141

[22] Filed: Feb. 6, 1996

[51] Int. Cl.[6] ..... A63G 1/24

[52] U.S. Cl. ..... 472/31; 472/3

[58] Field of Search ..... 472/3, 31, 27, 472/30, 44, 45, 46, 47

[56] References Cited

U.S. PATENT DOCUMENTS

| | | | |
|---|---|---|---|
| 3,707,282 | 12/1972 | Robinson | 472/46 X |
| 3,840,225 | 10/1974 | Fouché | 472/3 |
| 3,904,194 | 9/1975 | Schwarzkopf | 472/3 |
| 4,007,926 | 2/1977 | Ottaway | 472/3 X |
| 5,558,581 | 9/1996 | Knijpstra | 472/31 |

OTHER PUBLICATIONS

Chance Industries, Inc. "The Wipeout" Park Model brochure, undated.

Chance Industries, Inc. "Zipper" and Yo–Yo brochure, undated.

Chance Industries, Inc. "Skydiver", Skywheel, Zumur and Space Shuttle brochure, undated.

Man–Co Mfg., Inc., "Hurricane", Folding Round–Up, Super Round–Up and Folding Tip Top brochure, undated.

Meisho, "Scramble", Super Arm, Cine 2000, Big Earthquake Shock, Astro Swinger, Hurricane, Magic Palace and Fun House brochure, undated.

*Primary Examiner*—Kien T. Nguyen

*Attorney, Agent, or Firm*—Shook, Hardy & Bacon L.L.P.

[57] ABSTRACT

An amusement ride is provided in which passengers can be simultaneous subjected to three different types of movement. A circular motion is provided by the circular rotation of the head which mounts the passenger seats. A tilting motion is provided by mounting the head for tilting movement as it rotates in the circular path. The third type of motion is provided by mounting the passenger seats so that they rotate about an axis tangential to the circular path in which they travel.

7 Claims, 5 Drawing Sheets

AMUSEMENT RIDE

BACKGROUND OF THE INVENTION

The present invention relates in general to amusement rides, and, more particularly, to amusement rides in which the riders are subjected to a movement in multiple directions.

Amusement rides are popular forms of entertainment for individuals of all ages. The excitement experienced by riders is often directly related to the ability of the ride to subject the riders to various disorienting motions. For example, the standard ferris wheel is designed so that the riders travel in a circular path about the horizontal rotational axis of the ferris wheel. The riders, however, are generally maintained in an upright position as the ferris wheel rotates and are thus subjected to movement in only a single dimension. Other more complex rides have been designed which subject the riders to movement in two and three dimensions. As one example, a ferris wheel type ride has been developed in which the passenger cars rotate about an axis which is tangential to the circular path of the ferris wheel. This additional dimension of movement increases the disorientation and excitement experienced by the riders.

As riders become accustomed to the range of motions provided by conventional rides, more challenging rides must be developed. A need has thus developed for an amusement ride which subjects riders to movement in multiple dimensions to maintain the high level of thrills sought by many riders.

SUMMARY OF THE INVENTION

It is a primary object of this invention to provide an amusement ride which subjects passengers to movement in multiple dimensions so that greater excitement can be achieved by the disorienting effect of such movement.

To accomplish these and other related objects of the invention, in one aspect the invention is related to an amusement ride comprising: a base; a boom coupled with the base at one end and moveable at the other end from a lowered position to an elevated position; a rotatable top mounted at said other end of the boom, said top being mounted for tilting movement when said boom is in said elevated position; a drive mechanism for causing rotation of said top; a tilting mechanism for cause said tilting of the top; and a plurality of passenger seats mounted at circumferentially spaced apart positions on said top and rotatable with said top in a closed loop, each of said passenger seats being mounted for rotation about axes which are tangential to the loop. Normally, the loop will be circular and the seats are mounted for forward and backward rotation under the influence of inertial and centrifugal forces during operation of the ride.

In another aspect, the invention is related to a method of operating the ride, comprising the steps of rotating the top, raising the boom to elevate the top, tilting the top while elevated and rotating under conditions sufficient to cause the passenger seats to rotate forwardly and backwardly about an axis which is tangential to the rotational path that the seats are carried through by rotation of the top. At the end of the ride sequence, the boom can be lowered while the top is tilted and is still rotating. The top is then stopped from rotating to allow the passengers to disembark from the seats. Optionally, the seats can be locked against forward and backward rotation until the boom has been raised. In order to return the seats to the correct attitude at the end of the ride sequence, the rotational speed of the top can be increased to return the seats to an outward facing orientation. The locking mechanism can then be engaged to prevent forward and backward rotation or pivoting of the seats.

BRIEF DESCRIPTION OF THE DRAWINGS

In the accompanying drawings which form a part of the specification and are to be read in conjunction therewith and in which like reference numerals are used to indicate like parts in the various views.

DESCRIPTION OF THE PREFERRED EMBODIMENT

Figure 1:
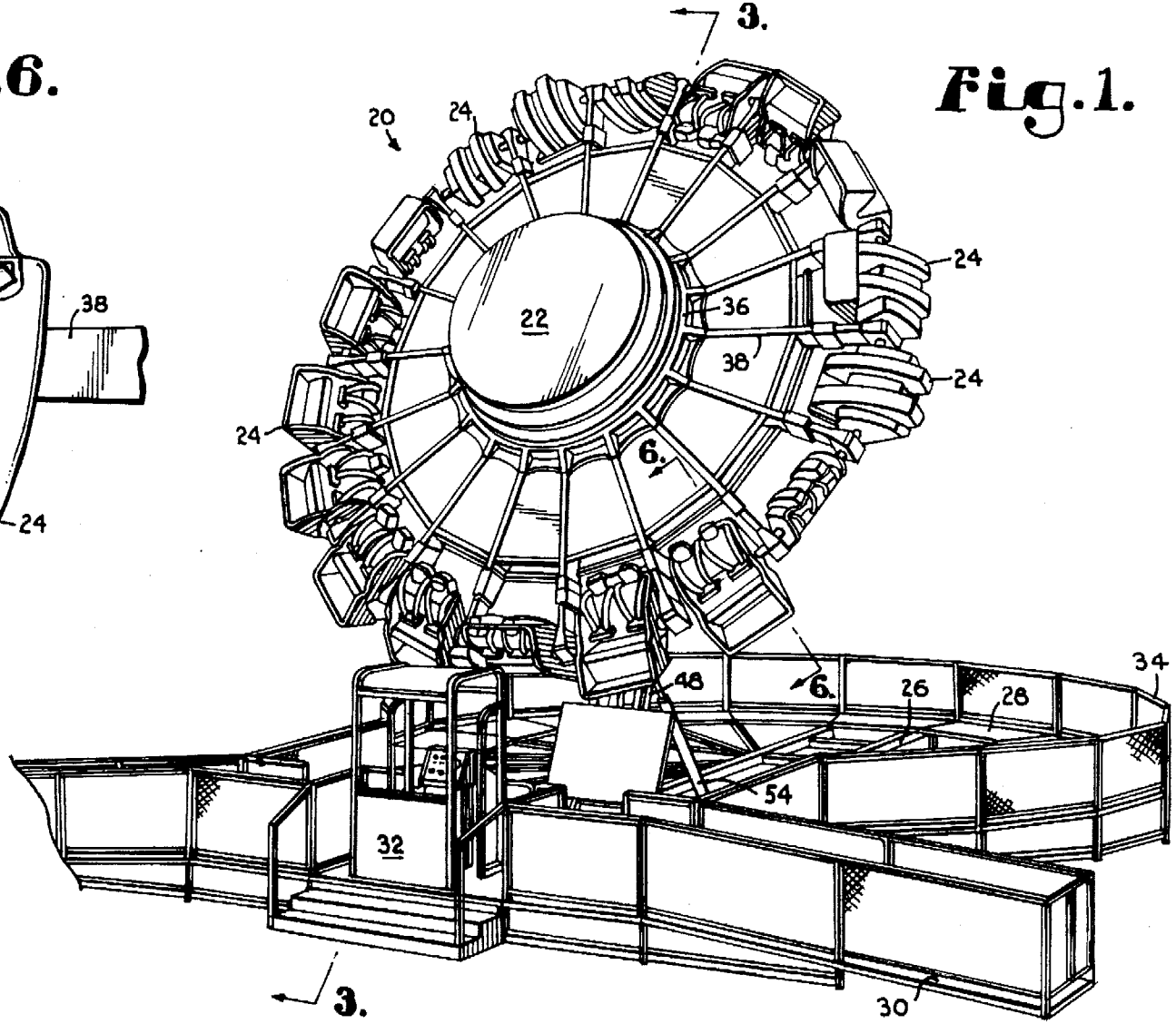
FIG. 1 is a perspective view of an amusement ride of the present invention shown in an operating position.
Figure 6:
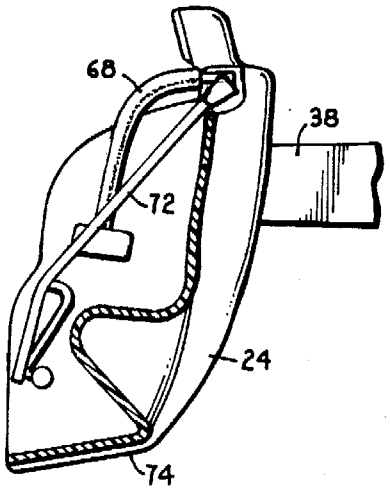
FIG. 6 is a side elevation view of the passenger seat taken in vertical section along line 6—6 of FIG. 1 in the direction of the arrows.

Referring now to the drawings in greater detail and initially to FIG. 1, an amusement ride constructed in accordance with the present invention is represented generally by the numeral 20. Ride 20 comprises a top 22 mounted for both rotating and tilting movement and carrying a plurality of circumferentially spaced passenger seats 24. The ride 20 includes a suitable base 26 which can be permanently installed at an amusement park or can be constructed for ready disassembly if the ride 20 is intended to be transported, between various site locations. A circular loading platform 28 and ramps 30 are provided for loading and offloading passengers and a control booth 32 is positioned to allow the ride operator to control the ride 20 while visually observing its operation. Fencing 34 is also provided to restrict access to the ride 20 and for forming passenger lines.

Figure 2:
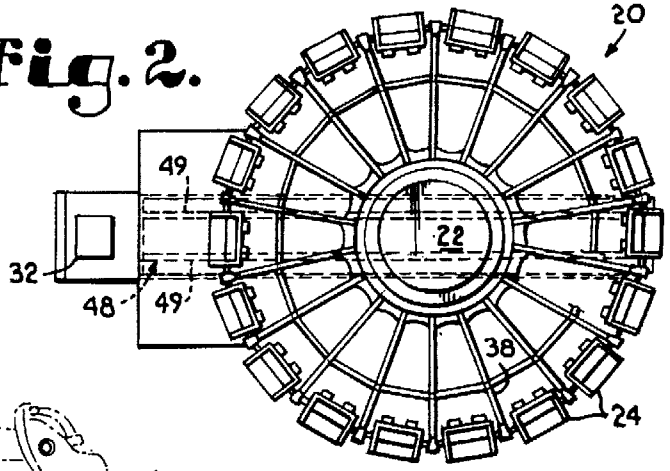
FIG. 2 is a top plan view of the amusement ride in a loading position, the ride being shown on a reduced scale from that used in FIG. 1.
Figure 3:
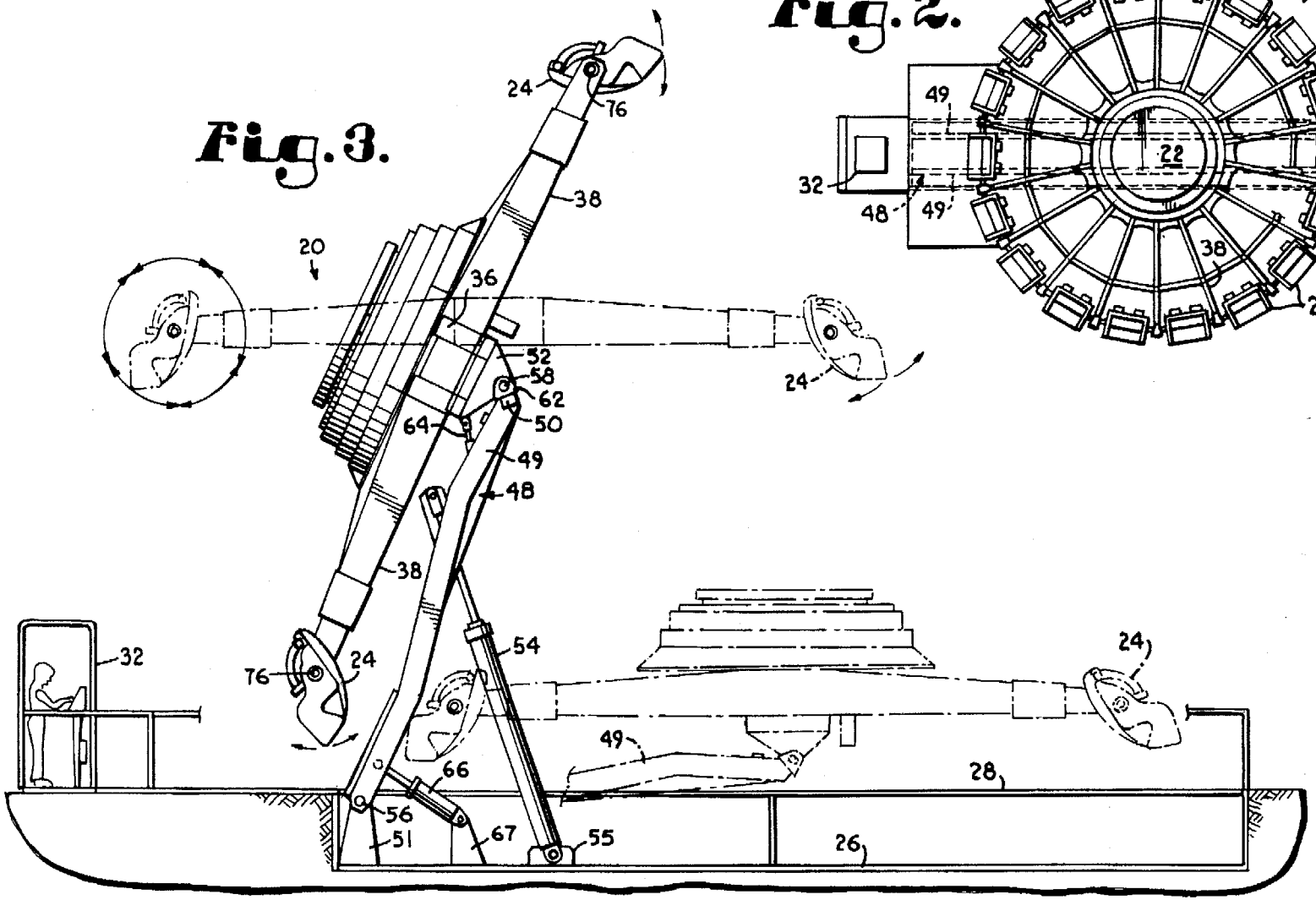
FIG. 3 is a side elevation view of the amusement ride taken in vertical section along line 3—3 of FIG. 1 in the direction of the arrows, phantom lines being used to show the loading position and an intermediate position of the ride.
Figure 4:
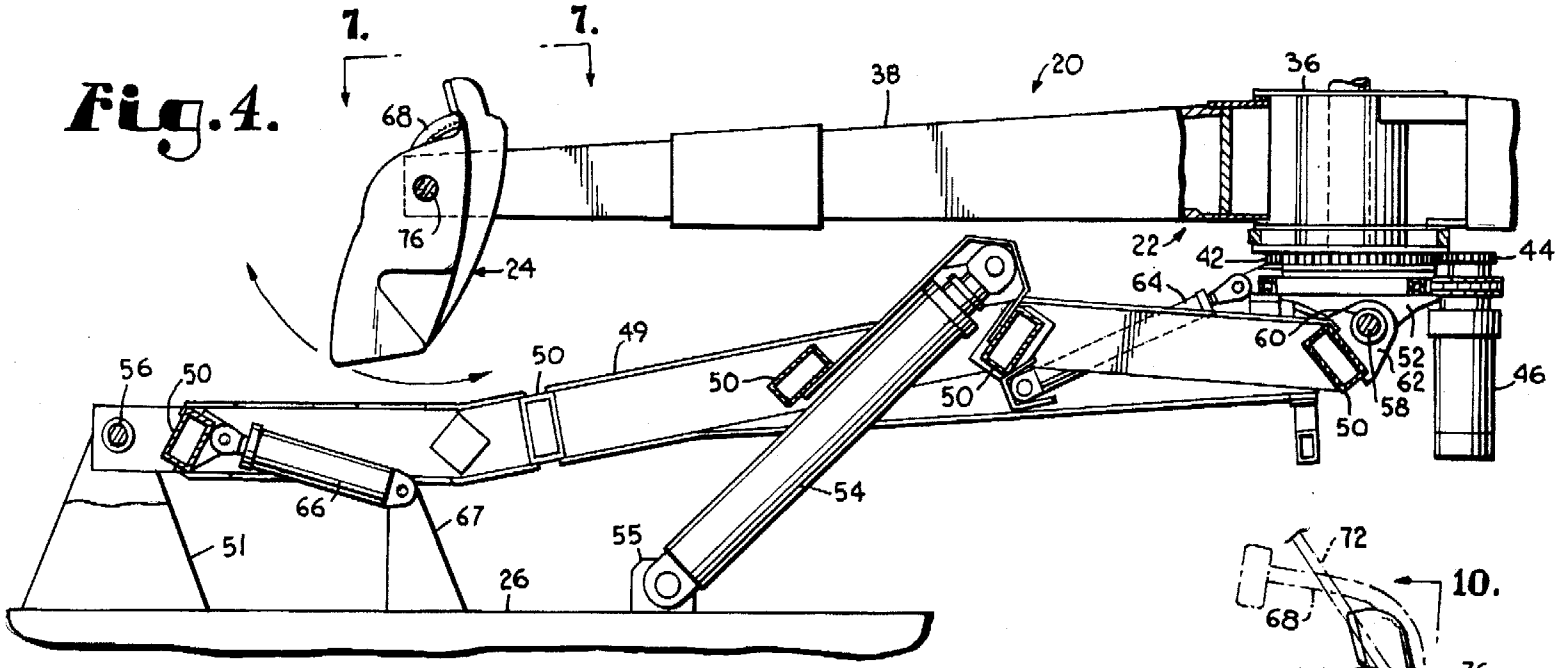
FIG. 4 is an enlarged side elevation view of the ride showing the boom and its operating mechanisms and a fragmentary portion of the rotatable top.
Figure 5:
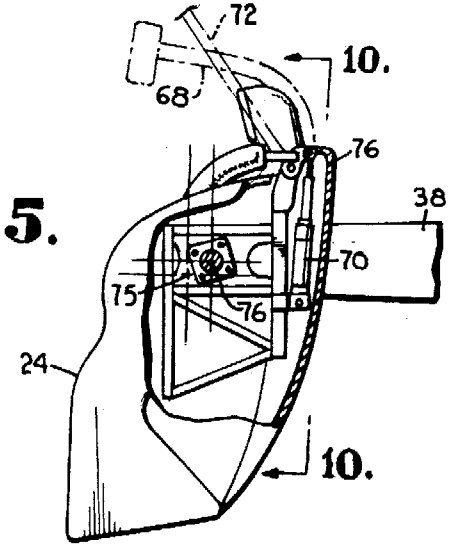
FIG. 5 is a slightly enlarged side elevation view of a passenger seat mounted on an end of a sweep arm, portions of the seat being broken away to illustrate internal components and phantom lines being used to showing the released position for the passenger restraints.
Figure 7:
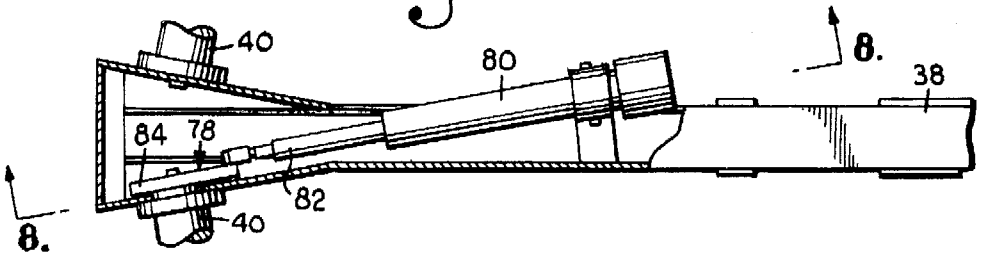
FIG. 7 is a fragmentary top plan view of the end portion of one of the sweep arms showing the braking mechanism used to lock a passenger seat against rotation during passenger loading and unloading.
Figure 9:
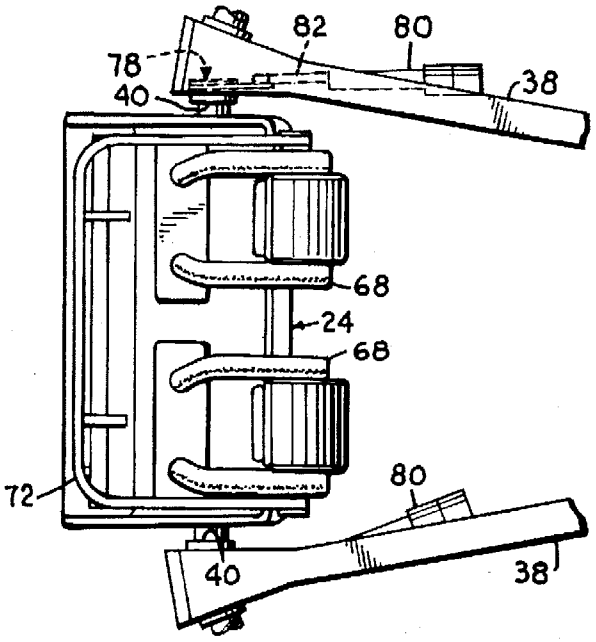
FIG. 9 is a top plan view showing one of the passenger seats and fragmental portions of the associated sweep arms.
Figure 8:
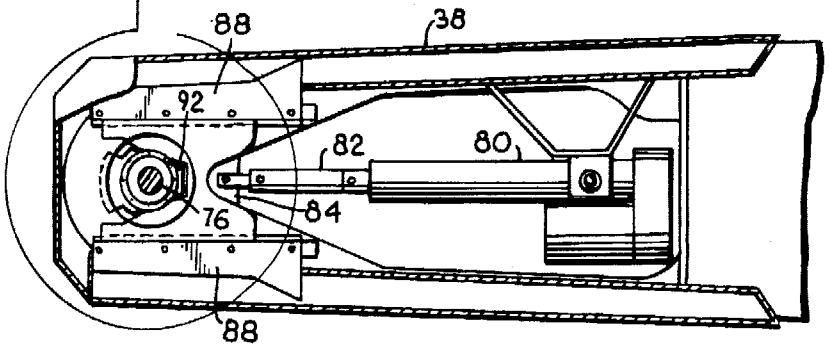
FIG. 8 is a side elevation view of the sweep arm shown in FIG. 6, portions being broken away to illustrate component parts of the braking mechanism.
Figure 10:
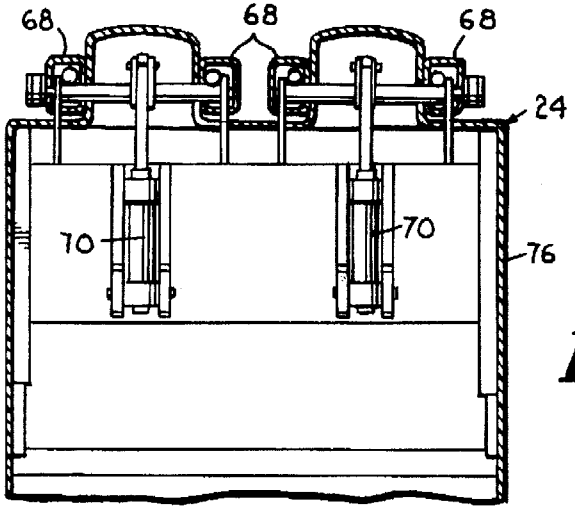
FIG. 10 is a back elevation view of one of the passenger seats taken in vertical section along line 10—10 of FIG. 5 in the direction of the arrows to show the operating mechanisms for the passenger restraints.

Turning additionally to FIGS. 2–4, the top 22 comprises a central hub 36 and a plurality of sweep arms 38 which extend radially from the hub 36 in a spoke-like fashion and carry the passenger seats 24. Each passenger seat 24 is positioned in an outwardly facing direction between the end portions of adjacent sweep arms 38. The passenger seats 24 are rotatably coupled to the sweep arms 24 using roller bearings 40 which permit 360° rotation of the seats in both forward and backward directions as indicated by the arrows in FIG. 4.

The sweep arms 38 are constructed from suitably rigid materials having sufficient strength to support the passenger load carried by the seats 24. The number of, and spacing between, adjacent sweep arms 38 is determined by the desired number and width of passenger seats 24. The length of the sweep arms 38 can also be varied as desired to provide the selected diameter for the top 22.

The hub 36 is rotatably driven by a gear 42 fixed below the hub. The gear 42 is in turn driven by a drive gear 44 carried on a shaft of an electric drive motor 46. It is to be understood that other drive mechanisms, including indirect drives, can be utilized if desired to achieve rotation of the top 22.

An elongated boom 48 is used to raise and lower the top 22 during operation of the ride 20. The boom 48 comprises a pair of spaced apart, parallel box beams 49 which are connected together by cross-braces 50 positioned along the length of the beams 49. The boom 48 is pivotally mounted at one end to a stanchion 51 on base 26 and is pivotally connected at the other end to a tilt head 52 which forms a portion of and allows tilting of top 22. A hydraulic lift cylinder 54 is used to move the boom 48 between elevated and lowered positions. The lift cylinder 54 is pivotally mounted at one end to a stanchion 55 on the base 26 and at the other end with an intermediate portion of boom 48. Extension and retract of the lift cylinder 54 piston thus causes pivoting of boom 48 about a pivot axis 56.

The tilt head 52 is pivotally carried on the end of boom 48 opposite from the pivot axis 56. The tilt head 52 is constructed to connect the hub 36 to the end of the boom 48 in a manner which allows tilting movement of the hub and associated sweep arms 38 and passenger seats 24. The tilt head 52 is pivotally mounted to the boom 48 by a pivot pin 58 and bearings 60. The bearings 60 in turn are carried by brackets 62 which are mounted to the cross-brace 50 positioned at the end of boom 48.

Tilting movement of the tilt head 52 is controlled by a pair of double-acting leveling cylinders 64 which extend between the boom 48 and the tilt head 52. The leveling cylinders 64 operate to maintain the top 22 in a horizontal attitude while the boom 48 is being moved between its lowered and elevated positions. Once the boom 48 reaches its elevated positions, the leveling cylinders 64 are operated to tilt the top 22 to the desired angle with respect to the horizontal.

The leveling cylinders 64 are hydraulically connected to a slave cylinder 66 which extends between a stanchion 67 on the base 26 and the boom 48 near pivot axis 56. The hydraulic volume of the single slave cylinder 66 corresponds to the combined volume of the leveling cylinders 64 so that extension of the piston in the slave cylinder causes a corresponding extension of both leveling cylinder pistons. As a result of this operational connection between the slave cylinder 66 and leveling cylinders 64, angular displacement of the boom causes an opposite and corresponding angular displacement of the top 22, thereby maintaining the top 22 in a horizontal attitude during raising and lowering of the boom 48. Once the boom reaches its elevated operating position, the pistons in the leveling cylinders 64 may be retracted by opening a bypass valve (not shown) so that the top 22 can be tilted to a desired angle in relation to the horizontal.

Turning now to FIGS. 5–6 and 9–10, the passenger seat 24 will be described in more detail. Seat 24 faces radially outward during loading and unloading of passengers and is generally open at the front and top. The seat is sized to accommodate two passengers seated in side by side relationship and includes a pair of padded over-the-shoulder safety restraints 68, each of which is operable by an associated cylinder 70. A leg restraint 72 is also provided for each passenger in seat 24 and is manually operable by the ride operator. For appearance purposes, the cylinders 70 are preferably located interiorly of an outer shell 74 of seat 24.

The passenger seat 24 is mounted for forward and backward rotation by spindles 76 which extend from both sides of the seat and are received within the roller bearings 40 mounted in the ends of the sweep arms 38. The seats 24 are not powered for rotation but instead rotate as a result of inertial and centrifugal forces acting on the seat during operation of the ride 20. In order to achieve this rotation of the seats, it has been found that a center of gravity (designated by the numeral 75 in FIG. 5) of the unoccupied seats normally should be offset from the rotation axis of spindles 76. The positioning of the rotation axis in relation to the center of gravity should also be selected while giving consideration to the factors which affect the inertial and centrifugal forces exerted on the seat during operation of the ride. Among these factors are the radial distance of the seats 24 from the rotation axis of hub 36, the angle at which the top 22 is tilted from the horizontal, and the rotational speed of the top 22. While no mathematical formula has been determined for correlating these various factors, it has been found through experimentation with a top 22 having a 30 ft. diameter and rotating at 10.5 rpm, that optimum rotation of the seats 24 can be obtained by placing the center of gravity of the unoccupied seats 1.63 inches below and 2.5 inches radially outward from the pivot axis at spindles 76 and by tilting the operating top 22 at approximately 70° from the horizontal. In general, the top 22 should be tilted at an angle within the range of 45° to 80° from the horizontal, and more preferably from 55° to 75° from the horizontal to achieve seat rotation regardless of the diameter of the top 22.

Turning more specifically to FIGS. 7–8 and 11–13, a plurality of locking mechanisms 78 prevent rotation of the seats 24 during loading and unloading of the passengers and at selected times during the operation of ride 20. Each locking mechanism 78 includes an electric actuator 80 mounted within an associated sweep arm 38 and having a radially extendable and retractable arm 82. The arm 82 is connected by a radially adjustable clevis 83 to a slide block 84 which moves radially within V-shaped guide surfaces 86 presented by upper and lower guides 88. The slide block 84 has a cutout which forms a wide slot 90 which is shaped to capture a complementally shaped portion of a locking block 92 which is fixed to and rotatable with seat spindle 76. The locking block 92 is joined to the spindle by splines 94 and is held in place by a nut (not shown) threaded onto the associated end of the spindle 76.

Figure 12:
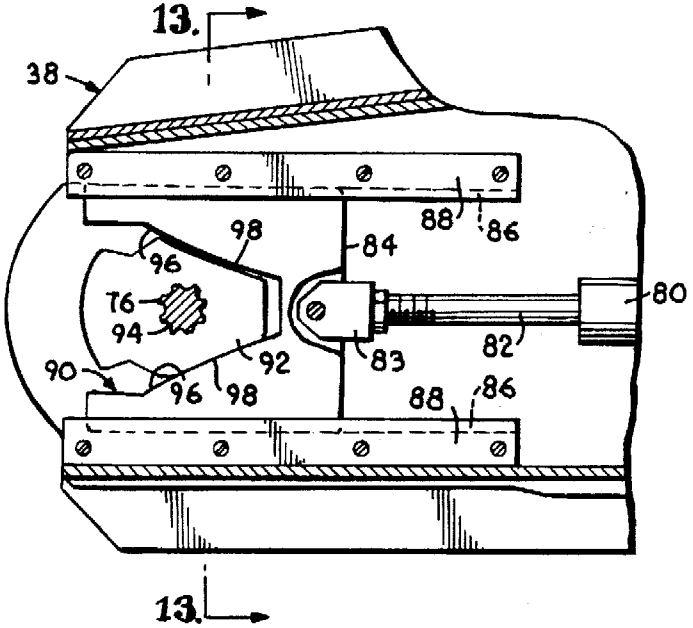
FIG. 12 is a side elevation view similar to that shown in FIG. 11 but showing the braking mechanism in an engaged position.
Figure 11:
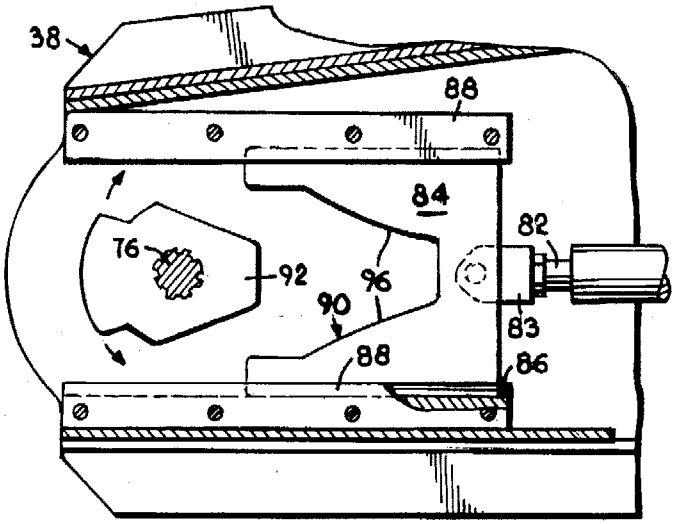
FIG. 11 is an enlarged side elevation view of one of the sweep arms taken within the circle designated by numeral 11 in FIG. 8 and showing further details of the braking mechanism which is shown in a retracted position.
Figure 13:
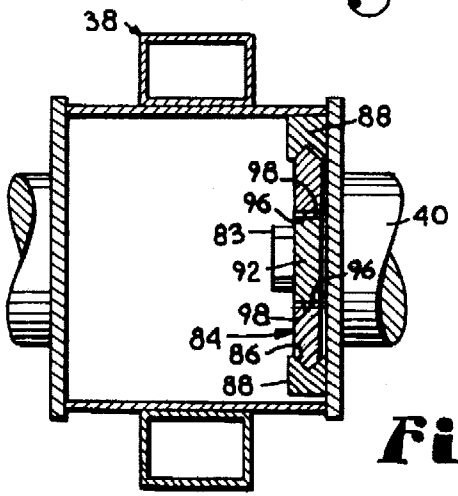
FIG. 13 is an end elevation view of the sweep arm taken in vertical section along line 13—13 of FIG. 12 in the direction of the arrows, and showing further details of the braking mechanism.

As is best illustrated sequentially in FIGS. 11 and 12, retraction of the actuator arm 82 causes the slide block 84 to be removed from engagement with the locking block 92 carried on seat spindle 76. This disengagement permits the seat spindle 76 to rotate within the associated bearings as the associated seat 24 is subjected to centrifugal and inertial forces during operation of the ride 20. When rotation of the seat 24 is to again be stopped, the actuator arm 82 is extended to bring the slide block 84 back into engagement with the locking block 92.

It is important that the slide block 84 be able to initially capture the locking block 92 even while the seat 24 is pivoting back and forth. To accomplish this objective, the forward end of the slot 90 formed in the slide block 84 is of a greater dimension than the receiving end of the locking block 92. This allows the seat and locking block 92 to be pivoting through a preselected range of motion as the slide block 84 is advancing into engagement with the locking block 92. The narrowing guide surfaces 96 of the slot 90 then contact the complementally shaped guide surfaces 98 on the locking block 92 to progressively restrict the pivoting freedom of the seat 24 and locking block. When the actuator arm 82 is fully extended, the contacting guide surfaces 96 and 98 lock the seat 24 in the desired attitude and prevent pivoting movement of the seat 24.

In order to ensure that the slide block 84 does not advance while the locking block 92 is rotating or is pivoting beyond the preselected range of movement, the top 22 is returned to a horizontal position and rotated at a sufficient speed so that the centrifugal and inertial forces acting on the seat 24 return the seat to the outward facing position and prevent forward and backward rotation of the seat 24.

The operation of ride 20 commences by rotating the top 22 using electric motor 46 after the passengers have been loaded into seats 24. Normally, rotation of top 22 will begin while the boom 48 is still in the lowered position but it will be appreciated that rotation can be delayed until the top is raised. The locking mechanism 78 is also normally engaged to prevent backward and forward rotation of seats 24 about the tangential pivot axis. The lift cylinder 54 is then extended to raise the spinning top 22 upwardly. The top 22 is maintained in a horizontal attitude during lifting of boom 48 by the interconnection between the slave cylinder 66 and leveling cylinders 64. As the boom 48 elevates, the slave cylinder 66 extends and cause a corresponding extension of leveling cylinders 64. Extension of leveling cylinders 64, in turn, causes pivoting of the tilt head 52 to maintain the top 22 in the desired horizontal position.

Once the boom 48 is fully elevated, the leveling cylinders 64 are retracted to cause tilting of the top 22 from the horizontal position to a desired angle in relation to the horizontal. It will be appreciated that this tilting can also begin while the boom is being elevated. The seat locking mechanisms 78 are also released so that the seats 24 are free to pivot and then rotate forwardly and backwardly about their tangential pivot axes. This rotation of the seats 24 results from the centrifugal and inertial forces which are exerted on the seats during rotation and tilting of the top 22. It will be appreciated that the forces acting on the seats will varying depending on the rotational speed of the top and the angle at which the top is positioned. Release of the locking mechanisms 78 normally occurs after the boom 48 is raised but can occur earlier if desired.

The tilt angle of the top 22 may be varied during operation of the ride 20 or it may remain at a preselected angle. It can be seen that during operation of ride 20, passengers are subjected to motion in three dimensions as the top 22 rotates and tilts and the seats 24 rotate about axes tangential to the circular path they are carried through by the rotating top 22. This combination of motions and the planes that the passengers are carried through are particularly disorienting and thrilling even to seasoned passengers.

As the ride sequence is ending, the boom 48 is lowered while the top 22 is rotating and, preferably, while the top 22 is tilted at an angle to the horizontal. The hydraulic interconnection between the slave cylinder 66 and the leveling cylinders 64 is designed so that the leveling cylinders 64 remain retracted as the slave cylinder 66 retracts during lower of boom 48. This interconnection ensures that the top 22 is in a horizontal position when the boom 48 is fully lowered, thereby preventing contact between the top 22 and surrounding loading platform 28.

In order to return the seats 24 to the upright, outwardly facing position at the end of the ride sequence, the top 22 is run through a spin-out cycle which subjects the seats 24 to sufficient centrifugal and inertial forces to orient the seats in the desired position. The locking mechanism 78 is then engaged to prevent rocking movement of the seats. The spinning of the top 22 is then stopped and the passengers are free to leave seats 24 once the restraints 68 and 72 are released.

The sequencing and operation of the ride 20 is automatically controlled by a suitable controller (not shown) of various types know to those of ordinary skill in the art.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. An amusement ride comprising:

a base;

a boom coupled with the base at one end and moveable at the other end between a lowered position and an elevated position;

means coupled with the boom for moving the boom between the lowered and elevated positions:

a rotatable top mounted at said other end of the boom, said top being mounted for tilting movement between a generally horizontal position and a position tilted from the horizontal when said boom is in said elevated position;

a drive mechanism for causing rotation of said top;

a tilting mechanism coupled with the boom and the top and operable to maintain the top in said generally horizontal position while the boom is moving between the lowered and elevated positions and for causing said tilting of the top to said position tilted from the horizontal when the boom is in said elevated position; and a plurality of passenger seats mounted at circumferentially spaced apart positions on said top and rotatable with said top in a closed loop, each of said passenger seats being mounted for rotation about axes which are tangential to and coplanar with the loop.

2. The amusement ride as set forth in claim 1, wherein said top is mounted for tilting movement between said generally horizontal position and a tilted position at an angle of at least 45° to the horizontal.

3. The amusement ride as set forth in claim 1, wherein said top is mounted for tilting movement between said generally horizontal position and a tilted position at an angle of at least 70° to the horizontal.

4. The amusement ride as set forth in claim 1, wherein said closed loop is generally circular.

5. The amusement ride as set forth in claim 1, wherein said top includes a plurality of radially extending sweep arms and each of said passenger seats is rotatably mounted between the end portions of a pair of adjacent sweep arms.

6. The amusement ride as set forth in claim 5, wherein said passenger seats face radially outward when the boom is in the lowered position and are rotatable forwardly and backwardly through 360° arcs of rotation about said tangential axes when the boom is in the elevated position.

7. The amusement ride as set forth in claim 6, including a locking mechanism coupled with each of said passenger seats and operable to prevent said forward and backward rotation during loading and unloading of passengers in said seats.

* * * * *